United States Patent [19]

Scharton et al.

[11] Patent Number: 4,645,542

[45] Date of Patent: Feb. 24, 1987

[54] METHOD OF PRESSURE PULSE CLEANING THE INTERIOR OF HEAT EXCHANGER TUBES LOCATED WITHIN A PRESSURE VESSEL SUCH AS A TUBE BUNDLE HEAT EXCHANGER, BOILER, CONDENSER OR THE LIKE

[75] Inventors: Terry D. Scharton, Santa Monica; George B. Taylor, Culver City, both of Calif.

[73] Assignee: Anco Engineers, Inc., Culver City, Calif.

[21] Appl. No.: 604,048

[22] Filed: Apr. 26, 1984

[51] Int. Cl.[4] ..... B08B 3/12; B08B 5/00; B08B 9/02

[52] U.S. Cl. ..... 134/1; 15/1; 134/17; 134/21; 134/22.12; 134/22.18; 134/37; 165/95; 376/316

[58] Field of Search ..... 134/1, 10, 17, 21, 22.12, 134/22.18, 37; 165/95; 15/316 R, 404, 406, 1; 376/310, 316

[56] References Cited

U.S. PATENT DOCUMENTS

| | | | |
|---|---|---|---|
| 2,351,163 | 6/1944 | Thomas | 134/1 X |
| 3,154,890 | 11/1964 | Lemelson | 134/1 X |
| 3,409,470 | 11/1968 | Karpovich | 134/17 X |
| 3,420,758 | 1/1969 | Scheer | 134/1 X |
| 3,457,108 | 7/1969 | Hittel | 134/17 X |
| 3,517,674 | 6/1970 | Allen et al. | 134/1 |
| 3,687,369 | 8/1972 | Johnstone | 134/1 X |
| 3,916,844 | 11/1975 | Cassell | 376/316 X |
| 4,320,528 | 3/1982 | Scharton et al. | 376/310 |
| 4,359,962 | 11/1982 | Olsson et al. | 134/1 X |
| 4,366,003 | 12/1982 | Korte et al. | 165/95 |
| 4,390,034 | 6/1983 | Bes | 134/104 |
| 4,396,434 | 8/1983 | Forster | 134/1 |
| 4,407,236 | 10/1983 | Schukei et al. | 165/95 |
| 4,492,186 | 1/1985 | Helm | 165/95 |

FOREIGN PATENT DOCUMENTS

| | | | |
|---|---|---|---|
| 79/01019 | 11/1979 | PCT Int'l Appl. | 134/1 |

*Primary Examiner*—Ivars Cintins
*Assistant Examiner*—W. Gary Jones
*Attorney, Agent, or Firm*—Thomas I. Rozsa

[57] ABSTRACT

The present invention relates to an improved method of cleaning and removing the products of corrosion, oxidation and sedimentation which occur within and become attached to the walls of the interior of heat exchanger tubes which are located within a pressure vessel such as a tube bundle heat exchanger, boiler, condenser or the like, through utilization of a repetitive shock wave induced into a liquid which is placed within the tubes and then subsequently flushing the tubes. The shock wave serves to effectively and safely loosen the products of corrosion, oxidation and sedimentation which are located within or settle on the walls of the interior of the heat exchanger tubes, and thereby facilitates their easy removal through flushing and vacuuming the vessel. The shock waves are induced by air-gun type pressure pulse shock wave sources or pressurized gas-type pressure pulse shock wave sources.

48 Claims, 1 Drawing Figure

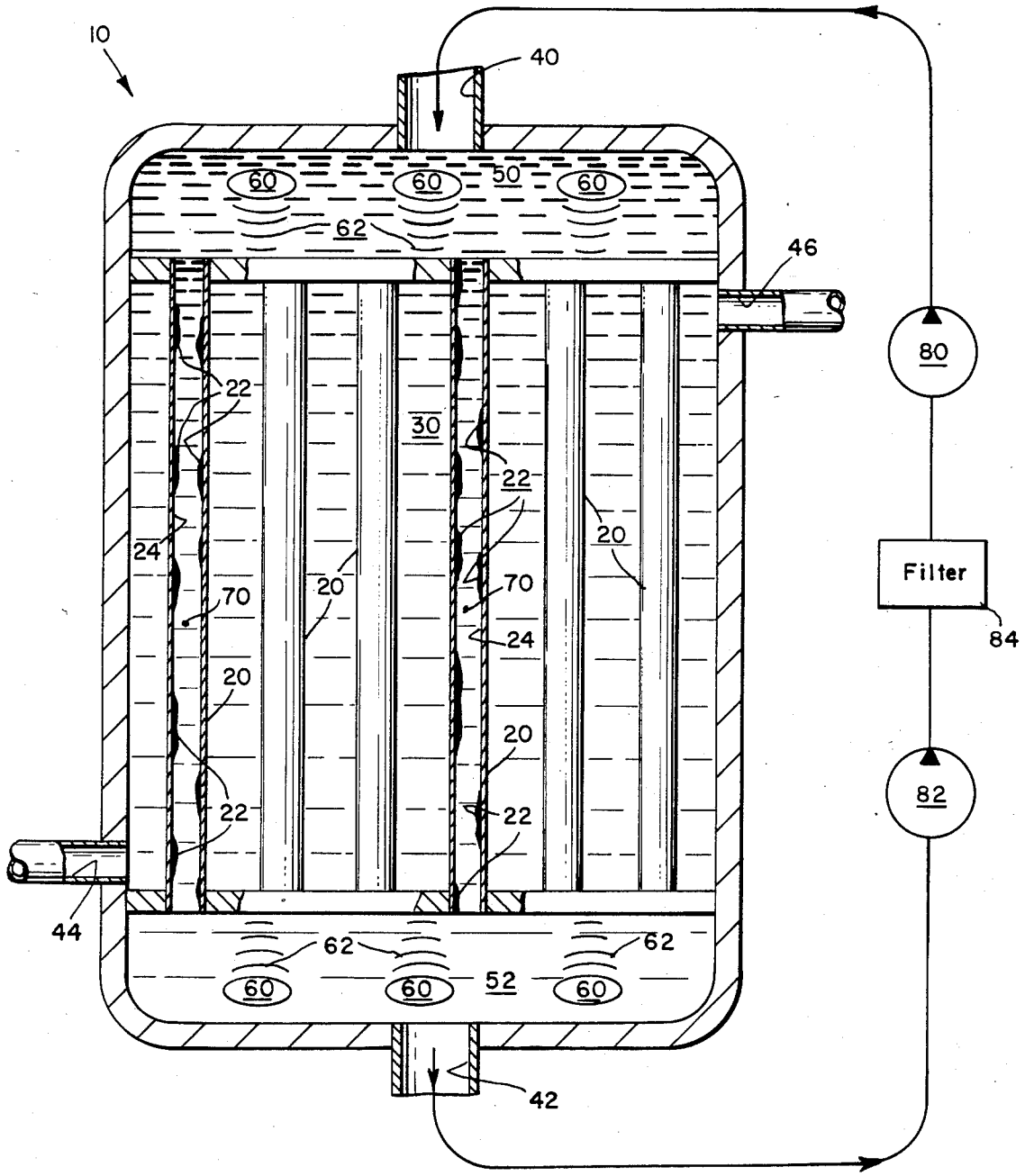
10
40
60
60
50
60
62
46
80
22
30
22
20
24
70
20
70
24
Filter
84
20
20
82
22
22
44
62
62
60
60
52
60
42

METHOD OF PRESSURE PULSE CLEANING THE INTERIOR OF HEAT EXCHANGER TUBES LOCATED WITHIN A PRESSURE VESSEL SUCH AS A TUBE BUNDLE HEAT EXCHANGER, BOILER, CONDENSER OR THE LIKE

BACKGROUND OF THE INVENTION

1. Field of the Invention

The present invention relates to an improved method of cleaning and removing the products of corrosion, oxidation and sedimentation which occur within and become attached to the walls of the interior heat exchanger tubes which are located within a pressure vessel such as a tube bundle heat exchanger, boiler, condenser, or the like, through utilization of a repetitive shock wave induced into a liquid which is placed within the tubes and then subsequently flushing the tubes. The shock wave serves to effectively and safely loosen the products of corrosion, oxidation and sedimentation which are located within or settle on the walls of the interior of the heat exchanger tubes, and thereby facilitates their easy removel through flushing and vacuuming the vessel. The concept of utilizing a repetitive pressure pulse shock wave to remove the buildup of sedimentation or "sludge" which accumulates in the bottom of a heat exchanger vessel around the exterior of the heat exchanger tubes is described in presently pending patent application Ser. No. 486,352, filed 4/19/83 and entitled "Method of Pressure Pulse Cleaning A Tube Bundle Heat Exchanger". The inventors of the invention in that patent application, Terry D. Scharton and G. Bruce Taylor, are the same inventors of the invention in the present patent application.

2. Description of the Prior Art

One of the major components of a heat exchanger are a large number of individual tubes which have fluid circulating through them. These heat exchangers or steam generators have experienced many problems due to the buildup of products of corrosion, oxidation, sedimentation and comprable chemical reactions within the heat exchanger.

The problem of removing the products of corrosion, oxidation and sedimentation in various locations on the outside of the tubes have been discussed in the following prior art patents:

1. U.S. Pat. No. 2,664,274 issued to Worn, et al.;
2. U.S. Pat. No. 2,987,086 issued to Branson;
3. U.S. Pat. No. 3,033,710 issued to Hightower, et al.;
4. U.S. Pat. No. 3,240,063 issued to Sasaki, et al.;
5. U.S. Pat. No. 3,295,596 issued to Ostrofsky, et al.;
6. U.S. Pat. No. 3,433,669 issued to Kouril;
7. U.S. Pat. No. 3,428,811 issued to Harriman, et al.;
8. U.S. Pat. No. 3,447,965 issued to Teumac, et al.;
9. U.S. Pat. No. 3,854,996 issued to Frost, et al.;
10. U.S. Pat. No. 4,120,699 issued to Kennedy, et al.;
11. U.S. Pat. No. 4,167,424 issued to Jubenville, et al.;
12. U.S. Pat. No. 4,320,528 issued to Scharton & Taylor.

They are also discussed in the following pending patent application and prior art literature:

1. Application Ser. No. 370,826 filed 4/22/82 by Scharton and Nikolchev for "Deep Crevice Ultrasonic Cleaner".

All of the above referenced patents have been extensively discussed in both U.S. Pat. No. 4,320,528 or else in presently pending U.S. patent application Ser. No. 370,826 filed on 4/22/82. The following two prior art publications have also been discussed in these references.

2. Chemical Cleaning of BWR and Steam Water system at Dresdent Nuc. Pw. Station, Obrecht et al., pp 1–18 (10/26/60) 21st Ann. Conf. of Eng.
3. Special Tech. Pub. 42 (1962) ASTM Role of Cavitation in Sonic Energy Cleaning, by Bulat.
4. R&D Status Report Nuclear Power Division, which appeared on pages 52 through 54 of the April 1981 issue of the EPRI Journal. The article was by John J. Taylor.

All of the prior art discussed above employs the use of ultrasonics. While the methods discussed in the prior art, especially those in U.S. Pat. No. 4,320,528 and application Ser. No. 370,826 are very effective and valuable, the requirement of using ultrasonics has several significant disadvantages. First, in order to generate the ultrasonic waves, expensive transduces must be used. This requires considerable effort and expense to bring the ultrasonic transducers to the site of the heat exchanger and then putting them in their proper place in the location of the heat exchanger. Second, in order to achieve an effective level of ultrasonic waves, it is often necessary to cut away a portion of the heat exchanger wall and put the face of the transducer at the location of the cut away portion. Many owners of the heat exhanger are very reluctant to have a portion of the wall cut away and then later welded back in place after the heat exchanger has been cleaned.

A third problem which arises with prior art applications is the use of corrosive chemicals to assist in the cleaning operation. While the chemicals servce to clean and remove the undesirable elements, they also serve to eat away at the various components of the heat exchanger. Therefore, it is desirable to find a method of cleaning which does not require the use of corrosive chemicals.

The method of pressure pulse cleaning described in presently pending U.S. patent application Ser. No. 468,352 by inventors Scharton and Taylor discusses the use of pressure pulse cleaning on the outside of the heat exchanger tubes and primarily adjacent the lower tube support sheet. None of the prior art references cited disclose or teach a method of pressure pulse cleaning the inside of the heat exchanger tubes.

SUMMARY OF THE PRESENT INVENTION

The present invention relates to an improved method of cleaning and removing the products of corrosion, oxidation and sedimentation which occur within and become attached to the walls of the interior of heat exchanger tubes which are located within a pressure vessel such as a tube bundle heat exchanger, boiler, condenser, or the like, through utilization of a repetitive shock wave induced into a liquid which is placed within tubes and then subsequently flushing the tubes. The shock waves serve to effectively and safely loosen the products of corrosion, oxidation and sedimentation which are located within or settle on the walls of the interior of the heat exchanger tubes, and thereby facilitates their easy removal through flushing and vacuuming the vessel.

It has been discovered, according to the present invention, that is a source of high energy is used to generate a shock wave or pressure pulse which is directed into the heat exchanger tubes which have been filled with a fluid medium such as water, then the shock wave will travel through the liquid medium and impinge upon the interior wall of the heat exchanger tubes and impinge upon the encrusted products of corrosion, oxidation and sedimentation, such as rust or sludge, agitate it and loosen it, and will permit these products of corrosion, oxidation and sedimentation to remain in suspension in the liquid medium from which it can be removed by a subsequent water flushing and vacuuming operation.

It has also been discovered, according to the present invention, that the use of a pressure pulse source will pull or loosen granular materials towards the source where they may be conveniently removed by wet vacuuming or other means.

It has also been discovered, according to the present invention, that the use of a shock wave to loosen the products of corrosion, oxidation and sedimentation from the interior of the heat exchanger tube walls permits the operation to be effectively achieved without the use of corrosive chemicals which might damage the components of the heat exhanger.

It has also been discovered, according to the present invention, that the use of a pressure pulse or shock wave can also be used in conjunction with chemical solvents, if desired to remove heavily encrusted materials from the interior walls of the heat exchanger tubes.

It is therefore an object of the present invention to provide a method for quickly and efficiently loosening the products of oxidation, corrosion and sedimentation from the interior walls of the heat exchanger tubes in steam generators, boilers, condensers and the like.

It is another object of the present invention to provide a method of cleaning the interior walls of heat exchanger tubes without corrosive chemicals but which also can be used in conjunction with corrosive chemicals if desired.

It is yet another object of the present invention to provide a method for providing such pressure pulses or shock waves which can be utilized with existing vessels containing heat exchanger tubes and which will not require the cutting away of a portion of the wall of the vessel to put the pressure source into the vessel wall.

It is a further object of the present invention to provide a method for cleaning the interior of heat exchanger tubes which can use either a gaseous source, a liquid source or an electrical source of generating the pressure pulse which is used to agitate and loosen the produces of corrosion, oxidation or sedimentation and keep it in suspension.

Further novel features and other objects of the present invention will become apparent from the following detailed description, discussion and the appended claims taken in conjunction with the drawings.

DRAWING SUMMARY

Referring particularly to the drawings for the purpose of illustration only and not limitation, there is illustrated:

The FIGURE is a side sectional view of a heat exchanger which contains a tube bundle throught which fluid is circulated, with the sources of pressure pulses inserted into the heat exchanger. The vacuuming or cleaning system is also schematically depicted.

DETAILED DESCRIPTION OF THE PREFERRED EMBODIMENT

Although the method of the present invention will now be described with reference to specific embodiments in the drawings, it should be understood that such embodiments are by way of example only and merely illustrative of but a small number of the many possible specific embodiments which can represent applications of the principals of the invention. Various changes and modifications obvious to one skilled in the art to which the invention pertains are deemed to be within the spirit, scope and comtemplation of the invention as further defined in the appended claims.

With reference to the drawing of the invention in detail, there is shown at 10 a heat exchanger. This can be any one of a multiplicity of heat exchangers, such as a steam generator in a nuclear power plant, a boiler, a condenser or the like. The specific apparatus with which the method of the present invention will be illustrated is a heat exchanger or steam generator which can be utlized in conjunction with a nuclear reactor. In general, the heat exchanger 10 contains a large multiplicity of heat exchanger tubes 20. The tubes 20 are surrounded by a liquid such as water 30. In operation, water under high temperature is fed into the heat exchanger tubes 20 and the heat is transmitted to the surrounding water 30, which in turn is turned into steam. There are numerous embodiments for heat exchangers. One type, called a U-bend type, was discussed in U.S. Pat. No. 4,320,528. The heat exchanger illustrated in the FIGURE is of a straight-line type, where the heat exchanger tubes 20 run in a straight line and do not bend. It is emphasized that the principals of the present invention can be utilized with any type of heat exchanger design. In operation, the water under high temperature (from example, for a nuclear reactor) enters through entrance passage 40 and exits through exit passage 42 at a significantly lower temperature since the heat has been transmitted to the secondary fluid 30. The secondary fluid 30 enters through inlet 44 and exits as steam through outlet 46. This high pressure steam can be used to drive a turbine.

The primary fluid which comes in at high temperature can be water or a gas, such as helium. Liquid sodium can be also be used. The secondary fluid 30 is usually water.

During the process described above, a large amount of moisture and heat is generated within the steam generator 10. This leads to corrosion of various portions of the steam generator 10. The problem which the present invention is concerned with is removal of the corrosion which forms and adheres to the internal wall of the heat exchanger tubes 20. These products of corrosion, oxidation and sedimentation are shown at 22 inside the heat exchanger tubes 20. These products of corrosion, oxidation and sedimentation can include rust, copper oxide and magnetite. The products can also be described as sludge, which includes these elements and other products of corrosion, oxidation and sedimentation. As these elements 22 continue to accumulate inside the heat exchanger tubes 20, on the inside wall 24 of the heat exchanger tubes 20, they begin to choke off and occlude the passageway. This serves to make the tube marginally useful and eventually, completely reduces the functionability of the tube. At that point, the tube must be plugged. When a sufficient number of such tubes become so occluded, the vessel becomes only marginally useful as a heat exchanger.

The prior art patents discussed in the Background of the Invention section of this document illustrate the use of ultrasonics to remove sludge and other corrosive products. Transducers are placed at various locations around or within the heat exchanger vessel and are used in conjunction with various chemical solvents. The combination of chemical solvent and sonic energy serves to agitate, loosen and dissolve the products of corrosion, oxidation and sedimentation. The ultrasonics are most effective when used in conjunction with a chemical solvent. Steam generator owners are reluctant to introduce chemical solvents into their generators. In addition, the use of a lot of transducers can be both expensive and cumbersome to install.

It is therefore the primary desire of the present invention to create a method of removing rust, sludge and other products of corrosion, oxidation and sedimentation from the interior wall of the heat exchanger tubes, which does not require the use of ultrasonics and their associated transducers and which will work with only water as the solvent. The general idea of the present invention is to use an "air gun" device to clean and remove the corrosion deposits from the heat exchanger tubes. The concept is to place fluid within the tubes and induce a repetitive shock wave within the fluid to thereby provide agitation which will loosen the rust, sludge, etc. and thereby permit it to be removed through a subsequent flushing operation.

The general concept of the present invention in using an air-gun device was discussed and disclosed in presently pending U.S. patent application Ser. No. 486,352, filed 4/19/83, and entitled "Method of Pressure Pulse Cleaning A Tube Bundle Heat Exchanger". The inventors of the invention in that patent application, Terry D. Scharton and G. Bruce Taylor, are the same inventors of the invention in the present patent application. The former patent application concentrated on using pressure pulses to remove sludge and other products of corrosion, oxidation and sedimentation which accumulates on the outside of the heat exchanger tubes at the location adjacent the tube support sheet at the lower end of the heat exchanger and other locations outside the heat exchanger tubes. The present invention is concerned with removing these elements from the interior wall of the heat exchanger tubes.

One application of the present invention is to use an air gun consisting of a high pressure air source which, for example, can be 2,000 psi, modulated by a sharp rise-time value at a repetition of 1 Hertz to repeatedly introduce shock waves and pressure fluctuations in the fluid layer above and in the encrusted deposits. The repetitive shock waves will loosen the deposits and move them into suspension with the fluid inside the heat exchanger tubes, where they can be removed by a subsequent flushing and vacuuming operation. In the preferred embodiment, the tubes are entirely filled with fluid such as water. The shock wave is then introduced into the water or other fluid which then transmits the shock wave to the encrusted deposits on the interior wall of the heat exchanger tubes.

An ultrasonic wave which was used in prior art applications is a wave of high frequency whose primary purpose was to induce cavitation. The high frequency ultrasonic waves have short wavelenths, low amplitudes and therefore low energy. In contrast, the concept of the present invention is to use a pressure pulse shock wave which is generated from a very intense and powerful compact source and is enhanced by frequent repetitions. The shock wave which is thereby produced is of lower frequency but of much higher energy which therefore can create a larger wavelength and a correspondingly larger movement on objects which it impacts. The pressure pulse spherical shock wave therefore moves across the water inside the heat exchanger tubes and impacts the adhered deposits in a discontinuous fashion, to thereby loosen up the deposits.

Having thus described the concept of the present invention, one embodiment to produce the above result is illustrated in FIG. 1. In most embodiments, the heat exchanger 10 has an inlet chamber 50 adjacent one end and an outlet chamber 52 which can be adjacent the other end as shown in FIG. 1. In U bend type reactors, the inlet and outlet chambers are adjacent each other and separated by a chamber wall, with both inlet and outlet chambers being at one end of the heat exchanger.

A multiplicity of Pressure Pulse Shock Wave Sources 60 are placed inside the inlet chamber 50 and outlet chamber 52 such that the pressure pulse generating face is aligned with the open ends of the heat exchanger tubes. In alternative embodiments, the Pressure Pulse Shcok Wave Sources 60 can be in either the inlet or the outlet chambers. In some embodiments where the chambers are not large enough, an interface means can be employed and fit through small holes in the heat exchanger walls so that the pressure pulse first travels through the interface means before traveling into the heat exchanger tubes.

The preferred method of the present invention is as follows. A multiplicity of Pressure Plse Shock Wave Sources 60 is placed in both the inlet chamber 50 and the outlet chamber 52, with the pulse wave generating face aligned with the openings in the heat exchanger tubes 20. Where applicable, depending on the type of Pressure Pulse Shock Wave Source 60 used and the amount of space available in the chambers, an interface means can be used so that the source 60 is outside the heat exchanger 10 and the interface means is inserted through openings in the heat exchanger to permit the shock wave to be transmitted from the source 60 through the interface means and to the openings in the heat exchanger tubes. The heat exchanger tubes 20 are filled with a fluid which can be a liquid such as water 70. The liquid 70 is placed into the heat exchanger 10 through entrance passage 40. The entire vessel can be filled with the water so that water may also be at the location where the secondary fluid 30 is located during regular operation. The Pressure Pulse Shock Wave Sources 60 can also be immersed in the water. The Pressure Pulse Shock Wave Sources 60 are then activated to emit a very intense and powerful shock wave 62 which is transmitted into the liquid 70 inside the heat exchanger tubes 20. The shock wave, which for example can be a spherical shock wave, is transmitted from the fluid 70 inside the heat eschanger tubes 20 to the internal wall 24 of the heat exchanger tubes and directly impinges the adhered deposits 22 on the internal wall 24, agitate the deposits 22, and loosen them.

In the preferred embodiment, one or a multiplicity of Pressure Pulse Shock Wave Sources 60 emit a high pressure shock wave 62 at a pressure ranging from 50 to 5,000 pounds per square inch (psi). The Pressure Pulse Shock Wave Sources 60 contain a valve which can be rapidly and repeatedly opened and closed to provide the pressure pulses. By way of example, the valve can be opened and closed approximately once each second. On a scale of pressure versus time, it is preferable to create a shock wave which produces a pressure level range of approximately 1/100th to 100 Bars of Pressure at 1 Meter. A desirable pressure scale is illustrated in Figure A 17 of the technical paper OTC 4255, "Marine Seismic Energy Sources Acoustice Performance Comparison" by Roy C. Johnsotn, ARCO Oil & Gas Co., and Byron Cain, Geophysical Service, Inc. The frequency of the shock waves produced can range from approximately 0 Hertz to 1,000 Hertz. The effect, therefore, is to tear a hole in the water 70, then into the sludge and other deposits 22, impinge upon the sludge and other deposits 22, agitate, loosen it, and pull it toward the pressure pulse shock wave sources where it can be removed. While the pressure source is in action to keep the sludge and other deposits in suspension in the fluid 70, the heat exchanger 10 is continuously flushed with water to remove the deposits 22. Both the tubes and the chamber or chambers leading to the tubes are vacuumed.

One illustration of the flushing operation is shown in the Figure. A first pump 80 circulates flushing water through entrance passage 40, through the heat exchanger tubes 20 and out exit passage 42, where a second pump 82 sucks the flushing water to a filter 84. The filter removes the entrained deposits of sludge, rust, magnetite, copper oxides, etc. which have been loosened and held in suspension. The clean water is then circulated back into the heat exchanger for another cycle. It is emphasized that this is just one illustration of a flushing system and other types of flushing and vacuuming systems which may include filters, settling tanks, separators, or a combination thereof are within the spirit and scope of the present invention.

Depending on the extent of the sludge and other deposits on the interior walls 24 of the heat exchanger tubes 20, and the amount and intensity of the desired applied pressure pulse, the time over which the pressure pulses are provided can range from approximately one hour to approximately twenty-four hours.

Another advantage of using the pressure pulse technique is that the spherical shock wave can bounce back and forth between opposite faces of the internal tube wall 24, to thereby intensify the applciation of the pressure to loosen the deposits and put them into suspension. While any type of air pressure generating source is within the spirit and scope of the present invention, it is preferred that the source emit a non-oxidizing gas such as nitrogen. In this way, oxygen will not be placed inside the heat exchanger 10. This is important because the oxygen will lead to corrosion of the heat exchanger components which is exactly the problem the present invention is addressing.

So far, the present invention has been described with the use of an air source which can generate either an oxidizing gas or a non-oxidizing gas. It is also within the spirit and scope of the present invention to provide a Pressure Pulse Shock Wave Source from a water jet source or an electrical spark source. An air source,a water source and an electrial source are all usable with the present invention, provided the source creates a shock wave or pressure pulse which travels radially outward from the source, thereby giving everything in its path a kick. The repetitions can be approximately once each second with the frequencies and pressures previously set forth.

So far, the present invention has been described as being used only with fluid such as water. As previously mentioned, one advantage of the present invention is that it can be used without corrosive chemicals which might damage the components of the heat exchanger 10. However, the present invention can be used with cleaning solvents and chemicals placed inside the heat exchanger tubes in conjunction with, or else without, the fluid. When used in conjunction with chemicals, the use of the repetitive shock wave or pressure pulse induced in the cleaning solvent, fluid or chemical, provides agitation to loosen and transport the corrosion deposit and to bring fresh solvent to the corrosion/solvent interface. The technique, therefore, can be used to remove heavily encrusted deposits such as magnetite from the interior walls of the heat exchange tubes. One example of a chemical detergent is Ivory Snow or Tide laundry detergent.

Therefore, in summary, the present invention involves a method of removing the products of corrosion, oxidation and sedimentation which adhere to the internal wall of the respective heat exchanger tubes inside a tube bundle heat exchanger such as a steam generator for a nuclear reactor, a boiler or a condenser. The method includes placing a multiplicity of Pressure Pulse Shock Wave Sources into the chamber in the heat exchanger into which the open ends of the heat exchanger tube enter. This can be the inlet chamber and the outlet chamber of the heat exchanger or only a single chamber. The shock wave generating elements are aligned with the tube openings and face them. Therefore, the tubes can be bombarded with sonic waves from either both open ends or from one of the open ends. The method further includes filling the heat exchanger tubes with a fluid and activating the Pressure Pulse Shock Wave Sources to generate a series of repetitive shock waves approximately once every second into the fluid within the heat exchanger tubes and from the fluid against the interal walls and against the adhered products of corrosion, oxidation and sedimentation. The method includes continuing the generation of repetitive shock waves which are generated with pressure between approximately 50 pounds per square inch and 5,000 pounds per square inch. Which produce a range of frequences between 0 Hertz and 1,000 Hertz to create shock waves which produce a pressure level of approximately 1/100th to 100 Bars of Pressure at 1 meter and continuing the shock wave impact for approximately one to twenty-four hours whereby the impact of shock waves serves to agitate, loosen and pull the adhered products of corrosion, oxidation and sedimention and permits them to remain in suspension in the fluid inside the heat exchanger tubes, or pull them up near the Pressure Pulse Shock Wave source where they may be removed by vacuuming or other means. The vacuuming is for both the tubes and inlet and outlet chambers leading to the tubes. The method then involves flushing the heat exchanger tubes with a fluid and vacuuming the heat exchanger tubes to remove the fluid and carry the loosened products of corrosion, oxidation and sedimentation with it. The flushing operation may further comprise removal of the fluid containing the entrained particles of corrosion, oxidation and sedimentation and removing the particles from the fluid outside the heat exchanger before returning the cleaned fluid to the heat exchanger, thereby forming a fluid sweeping action. The particles may be removed from the fluid outside the heat exchanger by methods of filtering, settling or separating.

While the method has been summarized as placing the Pressure Pulse Shock Wave Sources inside the chamber, it is also within the spirit and scope of the present invention to place them outside the heat exchanger and then connect the Pressure Pulse Shock Wave Sources to the inlet and outlet chambers or a single chamber, as may be desired, such that the shock wave generated by the Pressure Pulse Shock Wave Sources are transmitted to the open end of the heat exchanger tubes which open into the chamber.

The fluid with which the heat exchanger tubes are filled can be a liquid such as water. The Pressure Pulse Shock Wave Sources can generate a non-oxidizing gas, an oxidizing gas, a jet of water or an electrical spark, which creates the shock wave.

Of course, the present invention is not intended to be restricted to any particular form or arrangement, or any specific embodiment disclosed herein, or any specific use, since the same may be modified in various particulars or relations without departing from the spirit or scope of the claimed invention herein above shown and described of which the method shown is intended only for illustration and for disclosure of an operative embodiment and not to show all of the various forms of modification in which the invention might be embodied.

The invention has been described in considerable detail in order to comply with the patent laws by providing a full public disclosure of at least one of its forms. However, such detailed description is not intended in any way to limit the broad features or principles of the invention, or the scope of patent monopoly to be granted.

What is claimed is:

1. In a tube bundle heat exchanger which includes a multiplicity of open ended heat exchanger tubes and where products of corrosion, oxidation, sedimentation and comparable chemical reactions adhere to the internal wall of the respective heat exchanger tubes, the heat exchanger being further characterized by a chamber which extends into one end of a group of open ends of the multiplicity of heat exchanger tubes, the method of removing the products of corrosion, oxidation, sedimentation and comparable chemical reactions which adhere to the internal wall of the respective heat exchanger tubes comprising:

a. placing at least one air-gun type pressure pulse shock wave source into said chamber such that the shock wave producing elements of the at least one air-gun type pressure pulse shock wave source face the open ends of the heat exchanger tubes which go into the chamber;

b. filling said heat exchanger tubes with a liquid;

c. activating said at least one air-gun type pressure pulse shock wave source to generate a repetitive series of explosive transient shock waves into said liquid within said heat exchanger tubes and from said liquid against the internal walls and against the adhered products of corrosion, exidation, sedimentation and comparable chemical reactions;

d. continuing the generation of repetitive, explosive, transient shock waves which are generated with pressure between approximately 50 pounds per square inch and 5000 pounds per square inch which result in energy predominantly in the frequency range between 1 Hertz and 1,000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate, loosen and move the adhered products of corrosion, oxidation, sedimentation and comparable chemical reactions.

2. The invention as defined in claim 1 comprising the further step of flushing the heat exchanger tubes with a liquid and vacuuming the heat exchanger tubes and chamber to remove the liquid and carry the loosened products of corrosion, oxidation, sedimentation and comparable chemical reactions with it.

3. The invention as defined in claim 1 wherein said liquid is water.

4. The invention as defined in claim 1 wherein said liquid is a cleaning chemical.

5. The invention as defined in claim 1 wherein the continuing shock wave impact and repetitive explosive transient shock waves and resultant liquid motion serves to permit the products of corrosion, oxidation, sedimentation and comparable chemical reactions to remain in suspension in said liquid and the heat exchanger is continuously flushed with said liquid which is circulated through an external cleaning system to remove suspended and dissolved contaminants from said liquid before it is returned to the heat exchanger.

6. The invention as defined in claim 5 wherein the external cleaning of the liquid is accomplished by the method of filtering.

7. The invention as defined in claim 5 wherein the external cleaning of the liquid is accomplished by the method of separating.

8. The invention as defined in claim 7 wherein the separating is performed through an ion exchange process.

9. The invention as defined in claim 1 wherein said tube bundle heat exchanger is a steam generator for a nuclear power plant.

10. The invention as defined in claim 1 wherein said tube bundle heat exchanger is a boiler.

11. The invention as defined in claim 1 wherein said tube bundle heat exchanger is a condenser.

12. The invention as defined in claim 1 wherein said products of corrosion, oxidation, sedimentation and comparable chemical reactions include rust, magnetite, copper oxides and sludge.

13. In a tube bundle heat exchanger which includes a multiplicity of open ended heat exchanger tubes and where products of corrosion, oxidation, sedimentation and comparable chemical reactions adhere to the internal wall of the respective heat exchanger tubes, the heat exchanger being further characterized by a chamber which extends into one end of a group of open ends of the multiplicity of heat exchanger tubes, the method of removing the products of corrosion, oxidation, sedimentation and comparable chemical reactions which adhere to the internal wall of the respective heat exchanger tubes comprising:

a. placing at least one air-gun type pressure pulse shock wave source outside said heat exchanger and connecting said at least one air-gun type pressure pulse shock wave source to said chamber such that the shock waves generated by the at least one air-gun type pressure pulse shock wave source are transmitted to the open end of the heat exchanger tubes which open into said chamber;

b. filling said heat exchanger tubes with a liquid;

c. activating said at least one air-gun type pressure pulse shock wave source to generate a repetitive series of explosive transient shock waves into said liquid within said heat exchanger tubes and from said liquid against the internal walls and against the adhered products of corrosion, oxidaton, sedimentation and comparable chemical reactions;

d. continuing the generation of repetitive, explosive, transient shock waves which are generated with pressure between approximately 50 pounds per square inch and 5000 pounds per square inch which result in energy predominantly in the frequency range between 1 Hertz and 1,000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate, loosen and move the adhered products of corrosion, oxidation, sedimentation and comparable chemical reactions.

14. The invention as defined in claim 13 comprising the further step of flushing the heat exchanger tubes with a liquid and vacuuming the heat exchanger tubes and chamber to remove the liquid and carry the loosened products of corrosion, oxidation, sedimentation and comparable chemical reactions with it.

15. The invention as defined in claim 13 wherein said liquid is water.

16. The invention as defined in claim 13 wherein said liquid is a cleaning chemical.

17. The invention as defined in claim 13 wherein the continuing shock wave impact and repetitive explosive transient shock waves and resultant liquid motion serves to permit the products of corrosion, oxidation, sedimentation and comparable chemical reactions to remain in suspension in said liquid and the heat exchanger is continuously flushed with said liquid which is circulated through an external cleaning system to remove suspended and dissolved contaminants from said liquid before it is returned to the heat exchanger.

18. The invention as defined in claim 17 wherein the external cleaning of the liquid is accomplished by the method of filtering.

19. The invention as defined in claim 17 wherein the external cleaning of the liquid is accomplished by the method of separating.

20. The invention as defined in claim 19 wherein the separating is performed through an ion exchange process.

21. The invention as defined in claim 13 wherein said tube bundle heat exchanger is a steam generator for a nuclear power plant.

22. The invention as defined in claim 13 wherein said tube bundle heat exchanger is a boiler.

23. The invention as defined in claim 13 wherein said tube bundle heat exchanger is a condenser.

24. The invention as defined in claim 13 wherein said products of corrosion, oxidation, sedimentation and comparable chemical reaction include rust, magnetite, copper oxides and sludge.

25. In a tube bundle heat exchanger which includes a multiplicity of open ended heat exchanger tubes and where products of corrosion, oxidation, sedimentation and comparable chemical reactions adhere to the internal wall of the respective heat exchanger tubes, the heat exchanger being further characterized by a chamber which extends into one end of a group of open ends of the multiplicity of heat exchanger tubes, the method of removing the products of corrosion, oxidation, sedimentation and comparable chemical reactions which adhere to the internal wall of the respective heat exchanger tubes comprising:

a. placing at least one pressurized gas-type pressure pulse shock wave source into said chamber such that the shock wave producing elements of the at least one pressurized gas-type pressure pulse shock wave source face the open ends of the heat exchanger tubes which go into the chamber;

b. filling said heat exchanger tubes with a liquid;

c. activating said at least one pressurized gas-type pressure pulse shock wave source to generate a repetitive series of explosive transient shock waves into said liquid within said heat exchanger tubes and from said liquid against the internal walls and against the adhered products of corrosion, oxidation, sedimentation and comparable chemical reactions;

d. continuing the generation of repetitive, explosive, transient shock waves which are generated with pressure between approximately 50 pounds per square inch and 5000 pounds per square inch which result in energy predominantly in the frequency range between 1 Hertz and 1,000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate, loosen and move the adhered products of corrosion, oxidation, sedimentation and comparable chemical reactions.

26. The invention as defined in claim 25 comprising the further step of flushing the heat exchanger tubes with a liquid and vacuuming the heat exchanger tubes and chamber to remove the liquid and carry the loosened products of corrosion, oxidation, sedimentation and comparable chemical reactions with it.

27. The invention as defined in claim 25 wherein said liquid is water.

28. The invention as defined in claim 25 wherein said liquid is a cleaning chemical.

29. The invention as defined in claim 25 wherein the continuing shock wave impact and repetitive explosive transient shock waves and resultant liquid motion serves to permit the products of corrosion, oxidation, sedimentation and comparable chemical reactions to remain in suspension in said liquid and the heat exchanger is continuously flushed with said liquid which is circulated through an external cleaning system to remove suspended and dissolved contaminants from said liquid before it is returned to the heat exchanger.

30. The invention as defined in claim 29 wherein the external cleaning of the liquid is accomplished by the method of filtering.

31. The invention as defined in claim 29 wherein the external cleaning of the liquid is accomplished by the method of separating.

32. The invention as defined in claim 31 wherein the separating is performed through an ion exchange process.

33. The invention as defined in claim 25 wherein said tube bundle heat exchanger is a steam generator for a nuclear power plant.

34. The invention as defined in claim 25 wherein said tube bundle heat exchanger is a boiler.

35. The invention as defined in claim 25 wherein said tube bundle heat exchanger is a condenser.

36. The invention as defined in claim 25 wherein said products of corrosion, oxidation, sedimentation and comparable chemical reactions include rust, magnetite, copper oxides and sludge.

37. In a tube bundle heat exchanger which includes a multiplicity of open ended heat exchanger tubes and where products of corrosion, oxidation, sedimentation and comparable chemical reactions adhere to the internal wall of the respective heat exchanger tubes, the heat exchanger being further characterized by a chamber which extends into one end of a group of open ends of the multiplicity of heat exchanger tubes, the method of removing the products of corrosion, oxidation, sedimentation and comparable chemical reactions which adhere to the internal wall of the respective heat exchanger tubes comprising:

a. placing at least one pressurized gas-type pressure pulse shock wave source outside said heat exchanger and connecting said at least one pressurized gas-type pressure pulse shock wave source to said chamber such that the shock waves generated by the at least one pressurized gas-type pressure pulse shock wave source are transmitted to the open end of the heat exchanger tubes which open into said chamber;

b. filling said heat exchanger tubes with a liquid;

c. activating said at least one pressurized gas-type pressure pulse shock wave source to generate a repetitive series of explosive transient shock waves into said liquid within said heat exchanger tubes and from said liquid against the internal walls and against the adhered products of corrosion, oxidation, sedimentation and comparable chemical reactions;

d. continuing the generation of repetitive, explosive, transient shock waves which are generated with pressure between approximately 50 pounds per square inch and 5000 pounds per square inch which result in energy predominantly in the frequency range between 1 Hertz and 1,000 Hertz for each pulse to create transient shock waves which produce a pressure level of approximately 1/100th to 100 Bars in the liquid of Pressure at 1 meter; and e. continuing the shock wave impact for approximately 1 to 24 hours whereby the impact of the repetitive explosive transient shock waves and resultant liquid motion serves to mechanically agitate, loosen and move the adhered products of corrosion, oxidation, sedimentation and comparable chemical reactions.

38. The invention as defined in claim 37 comprising the further step of flushing the heat exchanger tubes with a liquid and vacuuming the heat exchanger tubes and chamber to remove the liquid and carry the loosened products of corrosion, oxidation, sedimentation and comparable chemical reactions with it.

39. The invention as defined in claim 37 wherein said liquid is water.

40. The invention as defined in claim 37 wherein said liquid is a cleaning chemical.

41. The invention as defined in claim 37 wherein the continuing shock wave impact and repetitive explosive transient shock waves and resultant liquid motion serves to permit the products of corrosion, oxidation, sedimentation and comparable chemical reactions to remain in suspension in said liquid and the heat exchanger is continuously flushed with said liquid which is circulated through an external cleaning system to remove suspended and dissolved contaminants from said liquid before it is returned to the heat exchanger.

42. The invention as defined in claim 41 wherein the external cleaning of the liquid is accomplished by the method of filtering.

43. The invention as defined in claim 41 wherein the external cleaning of the liquid is accomplished by the method of separating.

44. The invention as defined in claim 43 wherein the separating is performed through an ion exchange process.

45. The invention as defined in claim 37 wherein said tube bundle heat exchanger is a steam generator for a nuclear power plant.

46. The invention as defined in claim 37 wherein said tube bundle heat exchanger is a boiler.

47. The invention as defined in claim 37 wherein said tube bundle heat exchanger is a condenser.

48. The invention as defined in claim 37 wherein said products of corrosion, oxidation, sedimentation and comparable chemical reactions include rust, magnetite, copper oxides and sludge.

* * * * *